US006860478B2

(12) United States Patent
Hirai

(10) Patent No.: US 6,860,478 B2
(45) Date of Patent: Mar. 1, 2005

(54) SHEET PROCESSOR WITH HOLE PUNCH CONTROLLER WHICH AVOIDS PUNCHING WHEN PREEXISTING HOLE EXISTS AND IMAGE FORMING APPARATUS PROVIDED WITH THE SAME

(75) Inventor: Katsuaki Hirai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/285,637

(22) Filed: Nov. 1, 2002

(65) Prior Publication Data

US 2003/0156872 A1 Aug. 21, 2003

(30) Foreign Application Priority Data

Nov. 28, 2001 (JP) ..... 2001-363339

(51) Int. Cl.[7] ..... B65H 35/04

(52) U.S. Cl. ..... 270/58.07; 270/58.09; 270/52.17; 399/407; 83/370

(58) Field of Search ..... 270/58.07, 58.08, 270/58.09, 52.17; 83/371, 372, 370; 399/407

(56) References Cited

U.S. PATENT DOCUMENTS

| | | | | | |
|---|---|---|---|---|---|
| 4,243,314 | A | * | 1/1981 | Bowe et al. | 355/29 |
| 5,508,799 | A | * | 4/1996 | Irie | 399/404 |
| 5,573,233 | A | | 11/1996 | Hirai et al. | 270/58.08 |
| 5,628,502 | A | * | 5/1997 | Amarakoon | 270/58.07 |
| 5,897,250 | A | | 4/1999 | Hirai et al. | 399/404 |
| 6,042,098 | A | * | 3/2000 | Kubota et al. | 270/58.02 |
| 6,065,383 | A | * | 5/2000 | Takaishi et al. | 83/368 |
| 6,283,470 | B1 | | 9/2001 | Hirai | 271/189 |
| 6,386,080 | B1 | | 5/2002 | Okamoto et al. | 83/73 |
| 6,474,633 | B1 | | 11/2002 | Hirai | 270/58.09 |

FOREIGN PATENT DOCUMENTS

| | | | | |
|---|---|---|---|---|
| JP | 08059048 | A * | 3/1996 | B65H/29/60 |
| JP | 11029254 | A * | 2/1999 | B65H/35/06 |
| JP | 11310337 | A * | 11/1999 | B65H/3/12 |
| JP | 11341255 | A * | 12/1999 | H04N/1/387 |
| JP | 2000-153953 | | 6/2000 | |
| JP | 2001335230 | A * | 12/2001 | B65H/35/06 |
| JP | 2002264086 | A * | 9/2002 | B26F/1/04 |

* cited by examiner

*Primary Examiner*—Patrick Mackey
(74) *Attorney, Agent, or Firm*—Fitzpatrick, Cella, Harper & Scinto

(57) ABSTRACT

A sheet processor capable of punching a sheet of paper without causing degraded alignment for filing or deteriorated quality of binding, and an image forming apparatus equipped with the sheet processor are provided. The sheet processor includes a punched hole detector for detecting whether a punched hole has already been made at an intended punching position in a sheet of paper on which an image has been formed, and a controller that controls a punching unit so as not to carry out a punching operation if it is determined that a punched hole exists at the intended punching position on the basis of a signal from the punched hole detector.

12 Claims, 14 Drawing Sheets

SHEET PROCESSOR WITH HOLE PUNCH CONTROLLER WHICH AVOIDS PUNCHING WHEN PREEXISTING HOLE EXISTS AND IMAGE FORMING APPARATUS PROVIDED WITH THE SAME

BACKGROUND OF THE INVENTION

1. Field of the Invention

The present invention relates to a sheet processor and to an image forming apparatus equipped with a sheet processor and, more particularly, to a sheet processor adapted to punch a sheet of paper after an image has been formed thereon.

2. Description of the Related Art

Hitherto, in some image forming apparatuses, such as copying machines, printers, facsimiles, or equipment combining these machines, the main unit thereof is provided with a sheet processor having a punching unit for punching a sheet of paper on which an image has been formed.

As a sheet processor equipped with such a punching unit, there is one disclosed in, for example, Japanese Patent Laid-Open No. 2000-153953. The sheet processor disclosed therein is provided with a punching unit adapted to permit a punching position to be controlled in a sheet conveying direction and in a direction orthogonal to the sheet conveying direction (hereinafter referred to as "the width direction").

The foregoing sheet processor has as many punches and dies as the number of the punch holes to be made in a sheet. The sheet processor includes a punching unit that moves the punches to the position of the holes in the dies so as to punch a hole in the sheet, an edge-in-the-conveying-direction detector for detecting the leading or trailing end of the sheet in the conveying direction, an edge-in-the-width-direction detector for detecting the side edge of the sheet in the width-wise direction, and a controller for controlling the punching unit in response to signals from the detectors, thus permitting highly accurate punching at preset positions.

With the recent trend toward improved binding quality, becoming available are apparatuses that permit binding in which inserting sheets of paper, such as index paper with tabs or chapter paper, are interleaved in a bundle of sheets of paper, and the inserting sheets of paper and plain paper are stapled or punched together. For the inserting sheets of paper, commercially available paper, customized paper, or the like are used, and in some cases they are pre-punched sheets of paper.

A conventional sheet processor, however, is set to perform the same punching operation for any types of paper. Hence, when unpunched plain paper is punched, inserting paper will be punched also.

As a result, the punched holes made by the sheet processor are added to the pre-punched holes in the inserting paper, causing the final holes to be excessively large. This has been adversely affecting the alignment for filing and contributing to poor appearance, with consequent poor binding quality.

SUMMARY OF THE INVENTION

Accordingly, the present invention has been made with a view toward solving the problem described above, and it is an object of the present invention to provide a sheet processor capable of punching a sheet of paper without degrading alignment for filing or the quality of binding, and to provide an image forming apparatus equipped with the sheet processor.

To this end, according to one aspect of the present invention, there is provided a sheet processor for punching, by a punching unit, a sheet of paper on which an image has been formed, the sheet processor including a punched hole detector for detecting whether a punched hole has already been punched at an intended punching position in the sheet of paper, and a controlling device for controlling the punching unit so as not to carry out a punching operation if it is determined that the punched hole has already been punched at the intended punching position on the basis of a signal from the punched hole detector.

According to another aspect of the present invention, there is provided a sheet processor for punching, by a punching unit, a sheet of paper on which an image has been formed, the sheet processor including a punched hole detector for detecting whether a punched hole has already been punched at an intended punching position in the sheet, a conveying device for conveying the sheet to the punching unit, and a controlling device for controlling the conveying device to convey the sheet to a position other than a position where the punching unit will punch a hole at the intended punching position if it is determined that there is already a punched hole at the intended punching position on the basis of a signal from the punched hole detector.

Preferably, the punching unit has a plurality of pairs of punching portions, and the punched hole detector is provided at at least one location in a sheet conveyance area corresponding to the plurality of punching portions.

According to yet another aspect of the present invention, there is provided a sheet processor for punching, by a punching unit, a sheet of paper on which an image has been formed, the sheet processor including a plurality of sheet accommodating trays for accommodating sheets of paper before images are formed thereon, a punching setting device for setting whether to carry out a punching operation for each sheet of paper accommodated in the plurality of sheet accommodating trays, and a controlling device for controlling the punching operation of the punching unit on the sheets of paper respectively accommodated in the plurality of sheet accommodating trays on the basis of the setting made by the punching setting device.

According to a further aspect of the present invention, there is provided an image forming apparatus including an image forming unit and the aforesaid sheet processor for punching a sheet of paper on which an image has been formed.

According to yet another object of the present invention, there is provided a sheet processor including a punching rod for punching a sheet of paper, a motor for driving the punching rod, a reflective sensor for detecting whether there is a preexisting hole at an intended punching position in a sheet of paper, and controlling means for controlling the motor so as to carry out punching if the reflective sensor does not detect a preexisting hole, or not to carry out punching if the reflective sensor detects a preexisting hole.

Preferably, a plurality of the punching rods and one such reflective sensor are provided.

Preferably, a plurality of the punching rods and as many such reflective sensors as the number of the punching rods are provided.

Further objects, features and advantages of the present invention will become apparent from the following description of the preferred embodiments with reference to the attached drawings.

DESCRIPTION OF THE PREFERRED EMBODIMENTS

Embodiments of the present invention will now be described in detail in conjunction with the accompanying drawings.

Figure 1:
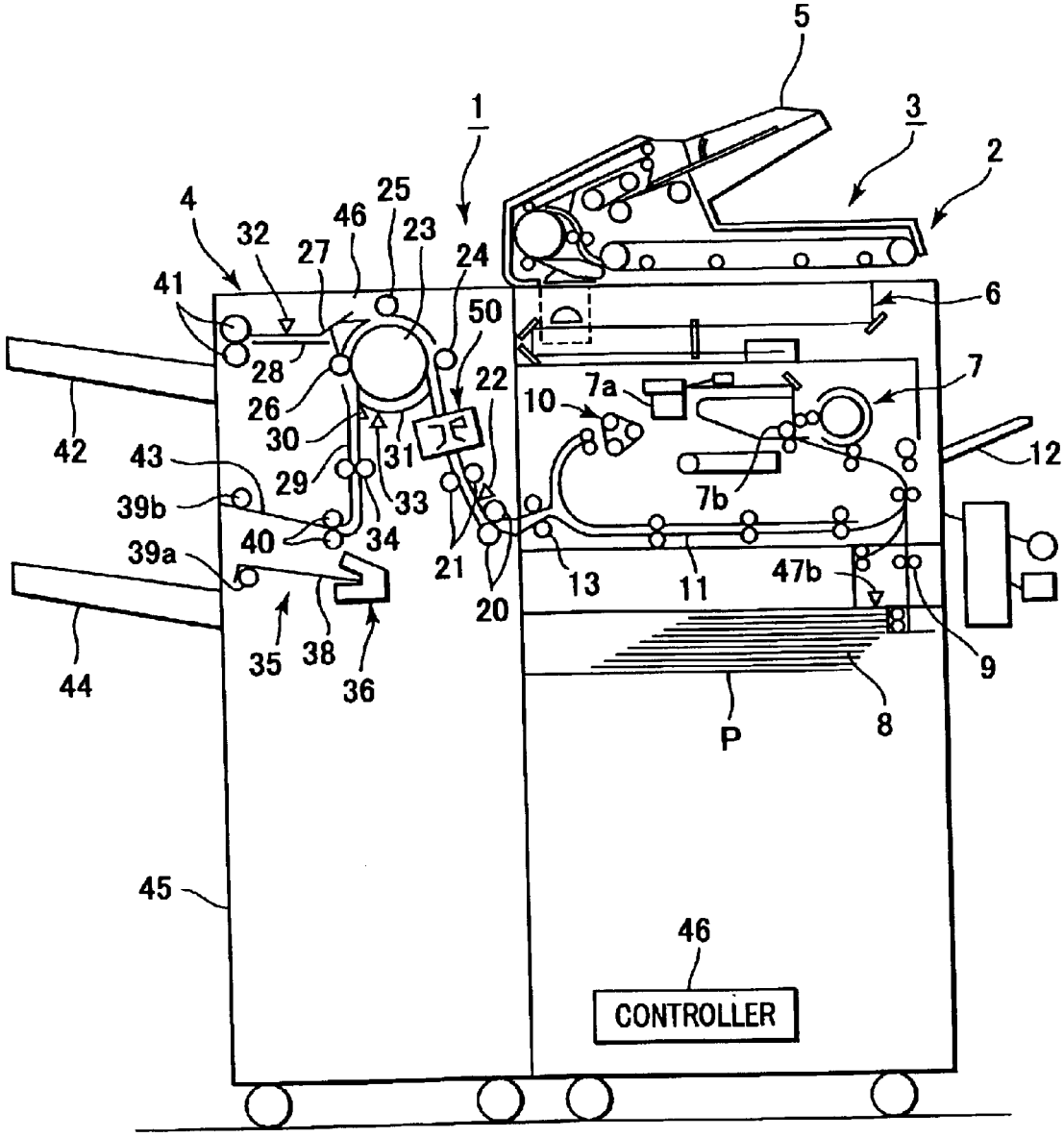
FIG. 1 is a schematic diagram of a copying machine, which is an example of an image forming apparatus provided with a sheet processor according to a first embodiment of the present invention.

FIG. 1 is a schematic diagram of a copying machine, which is an example of an image forming apparatus provided with a sheet processor according to a first embodiment of the present invention.

Referring to FIG. 1, a sheet processor 1 is connected to a main unit 2 of a copying machine 3. The main unit 2 has an optical device 6 in its upper portion, an image forming device 7 in its middle portion, and sheet cassettes 8, which are a plurality of sheet accommodating means that accommodate in its lower portion recording sheets (hereinafter referred to as "sheets") P, such as various sizes of plain paper or overhead projector (OHP) sheets.

In the copying machine 3, to copy or form an image onto the sheet P, the document automatically fed from a document feeder 5 provided on the upper surface of the main unit 2 is first optically read by the optical device 6, and the read information is supplied in the form of a digital signal to the image forming device 7. Then, the image is formed by the electrophotographic method on the basis of the information read by the optical device 6 as mentioned above.

More specifically, on the basis of the information read by the optical device 6, an optical irradiating device 7*a* applies a laser beam to a photosensitive drum 7*b* so as to form a latent image on the photosensitive drum. Thereafter, the latent image is developed with a toner to produce a toner image.

Meanwhile, concurrent with the operation for forming the toner image, the sheet P is conveyed to the image forming device 7 by a conveying roller 9 from the sheet cassette 8, and the toner image is transferred onto the sheet P. Then, the sheet P is conveyed to a fixing device 10. When the sheet P passes through the fixing device 10, the toner image is permanently fixed onto the sheet P by heat and pressure. This series of operations copies or forms the image onto a sheet of paper.

The copying machine 3 permits selection between a mode for forming an image on one side of the sheet P and a mode for forming images on both sides of the sheet P. In the mode for forming an image on one side of the sheet P, the sheet P is sent to the sheet processor 1 in the next step.

In the mode for forming images on both sides of the sheet P, the sheet P is conveyed to a resend path 11 by switchback to be carried back to the image forming device 7 so as to copy an image onto its back side. Thereafter, the sheet P is sent to the sheet processor 1. The sheet P may alternatively be supplied from a manual paper feed tray 12, which is another sheet accommodating device.

The sheet processor 1 is primarily equipped with a punching apparatus 50 serving as punching means for punching the sheet P on which an image has been formed by the main unit 2, and a finisher unit 4 capable of sheet processing, such as binding every predetermined number of sheets.

In the drawing, a first changeover flapper 27 directs the sheet P to a non-sorting path 28 or a sorting path 29, and a second changeover flapper 30 is provided at a branch point where the sheet P is directed to a sorting path 29 and a buffer path 31, which is a holding passage for temporarily storing or holding a sheet to be sent to the sorting path 29.

A first sheet sensor 22 detects the sheet P from the main unit 2, a second sheet sensor 32 detects the sheet P in the non-sorting path 28, a third sensor 33 detects the sheet P in the buffer path 31, a first pair of conveying rollers 21 conveys the sheet P from the main unit 2, and a second pair of conveying rollers 34 conveys the sheet in the sorting path 29.

The sheet processor 1 further includes a processing tray unit 35 that temporarily stores and aligns the sheets P, a stacking tray 44, and a sample tray 42. The processing tray unit 35 is constructed of an intermediate tray 38 for carrying out stapling by a stapling unit 36, a lower ejection roller 39*a* disposed at the ejection end of the intermediate tray 38, and an upper ejection roller 39*b* that is supported by a rocking guide 43 and abuts with pressure against the lower ejection roller 39*a* when the rocking guide 43 rocks to the position where it closes. The pair of ejection rollers 39*a* and 39*b* ejects a bundle of the sheets P on the intermediate tray 38 onto the stacking tray 44.

The stacking tray 44 and the sample tray 42 are properly used according to application. More specifically, the stacking tray 44 located at a lower level is selected for receiving copying outputs, printer outputs, or the like, while the sample tray 42 located at a higher level is selected for receiving a sample output, an interrupt output, a stacking tray overflow output, a function sorting output, a mixed job loading output, or the like.

A bundle stacking guide 45 supports the trailing edge (with respect to a bundle ejecting direction) of a bundle of sheets stacked on the stacking tray 44 and the sample tray 42. The bundle stacking guide 45 serves also as the housing of the sheet processor 1. A controller 46 controls the operation of the component units incorporated in the main unit 2.

In the sheet processor 1 constructed as described above, when the sheet P is ejected from the pair of ejection rollers 13 of the copying machine 3, the sheet P is first received by a pair of inlet rollers 20, then carried to the punching apparatus 50 by the first pair of conveying rollers 21. The passage of the sheet P is detected by the first sheet sensor 22.

Subsequently, the sheet P conveyed by the first pair of conveying rollers 21 is punched by the punching apparatus 50 in the vicinity of its trailing edge, then temporarily stored by being pressed by pressing rollers 24, 25, and 26 disposed around the buffer roller 23 against the rolling surface of the buffer roller 23, buffer roller 23 having a relatively large diameter.

Thereafter, if the mode has been set for the sorting mode, then the sheets P are ejected onto the intermediate tray 38 by a first pair of ejection rollers 40 disposed at the outlet of the sorting path 29 by switching by the first changeover flapper 27. Then, the sheets P ejected onto the intermediate tray 38 are subjected to processing, such as stapling, and ejected in a bundle onto the stacking tray 44 by the pair of ejection rollers 39*a* and 39*b*. In the non-sorting mode, the sheets P are directed by the first changeover flapper 27 and ejected onto the sample tray 42 by the second pair of ejection rollers 41 disposed at the outlet of the non-sorting path 32.

Figure 2:
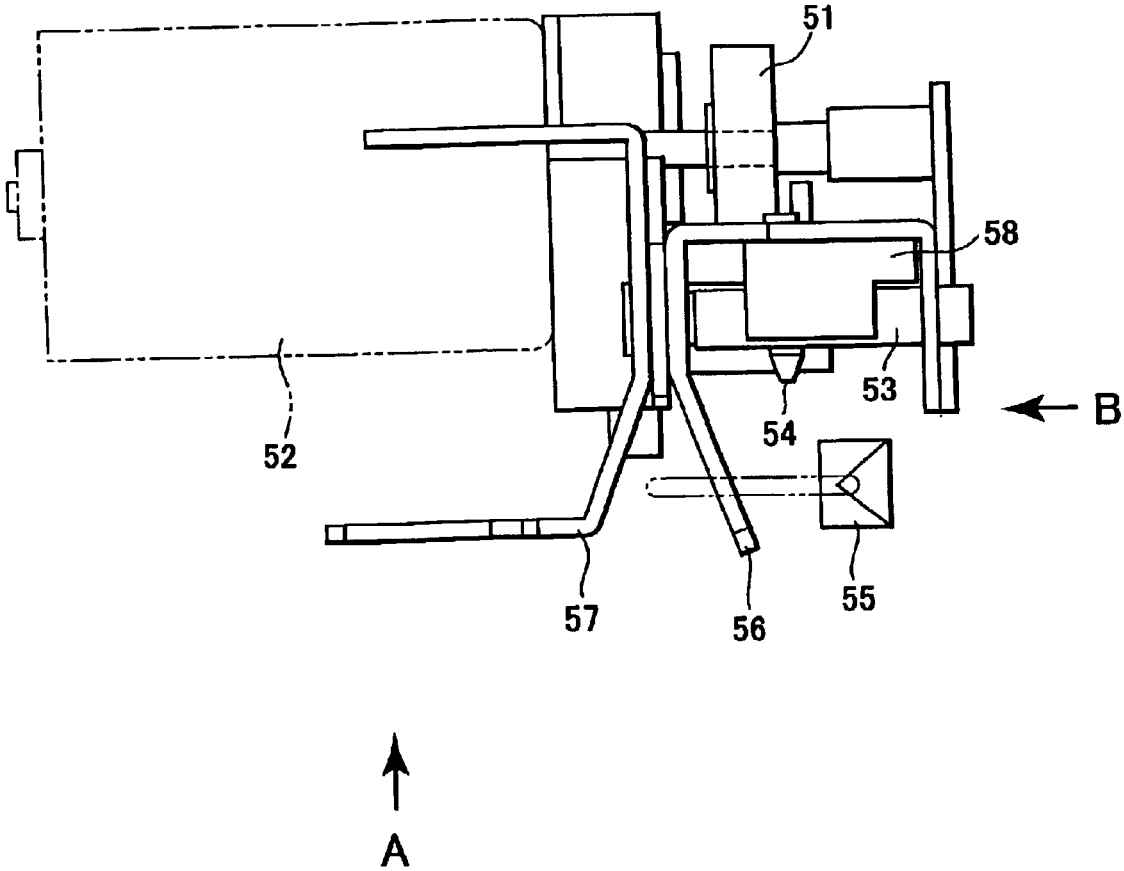
FIG. 2 is a front view of a punching apparatus of the sheet processor.
Figure 3:
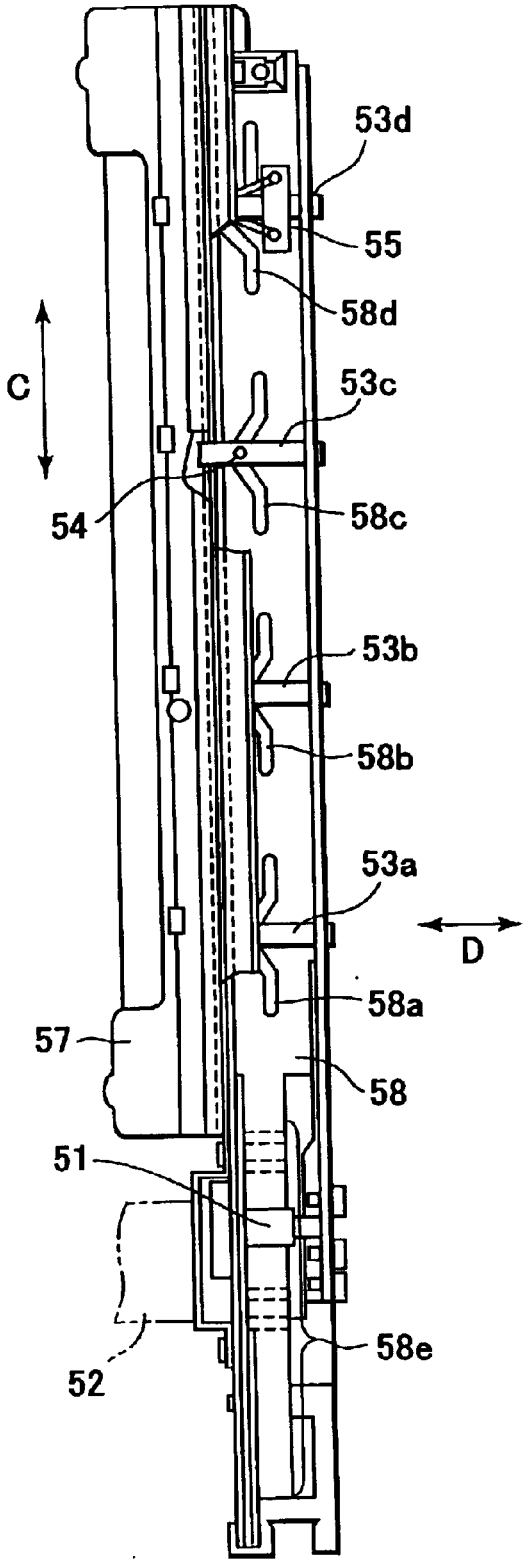
FIG. 3 is a fragmentary sectional view taken in the direction of arrow A shown in FIG. 2.
Figure 4:
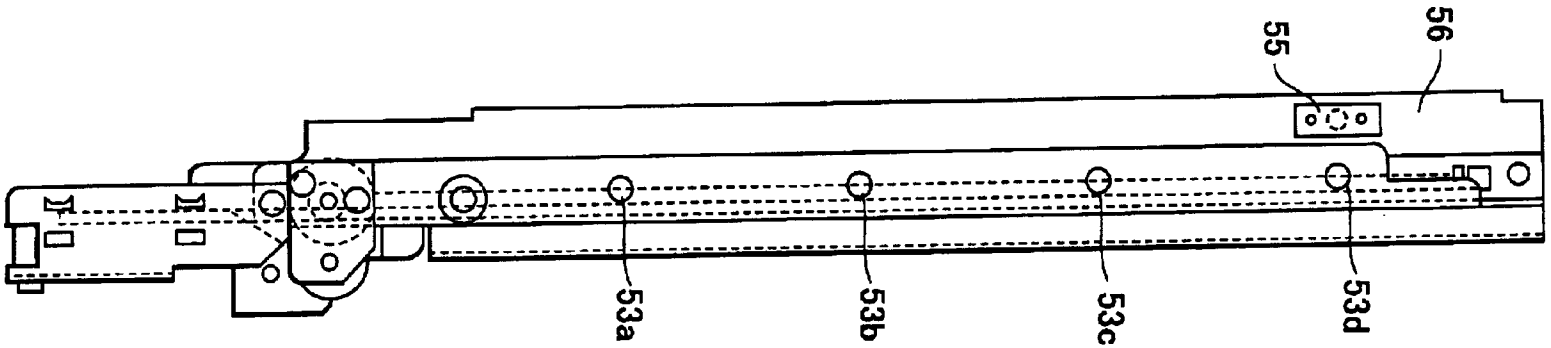
FIG. 4 is a fragmentary view taken in the direction of arrow B shown in FIG. 2.

The punching apparatus 50 is supported by a left guide frame 57 and a right guide frame 56, as shown in FIG. 3 showing the punching apparatus 50 of FIG. 2 observed from the direction indicated by arrow A, and in FIG. 4 showing the punching apparatus 50 of FIG. 2 observed from the direction indicated by arrow B.

The right guide frame 56 has a cam 58*e* meshed with a pinion gear 51 secured to a punch motor 52, and a slide cam rack 58 equipped with cam grooves 58*a* through 58*d* engaging a punch pin 54 secured to punches or punch rods 53 (53*a* through 53*d*).

When the drive of the punch motor 52 transmitted through the intermediary of the pinion gear 51 moves the slide cam rack 58 in a direction indicated by arrow C shown in FIG. 3, the punches 53 (53*a* through 53*d*) make one reciprocating travel in a punching direction indicated by arrow D, as the slide cam rack 58 moves.

At the position opposing the punches 53 (53*a* through 53*d*) of the left guide frame 57, there are formed dies (not shown) constituting, together with the punch 53, a plurality of pairs of punching portions. With this arrangement, as the punch 53 (53*a* through 53*d*) makes one reciprocating travel, the sheets P retained by the left guide frame 57 can be punched.

A reflective sensor 55 constituting a punched hole detector is secured to the right guide frame 56. There is at least one or more (one in this embodiment) reflective sensors 55 in a sheet conveyance area on the upstream side in the sheet conveying direction that is associated with the punch 53 (53*a* through 53*d*). The reflective sensor 55 detects whether the sheet P conveyed has already been punched.

The reflective sensor 55 outputs a "High" signal to the controller 46 when the sheet P passes, or outputs a "Low" signal to the controller 46 when the sheet P does not pass or the sheet P has already been punched.

Hence, when the sheet P with no punched holes passes, the following signals will be supplied to the controller 46: the signal level switches from "Low" to "High" when the leading edge of the sheet comes in, and switches from "High" to "Low" when the trailing edge of the sheet passes.

The above signals are compared with size signals (not shown), and the amounts of feed by a conveyance motor (not shown) for conveying the sheet P thereby to determine that a hole has not been punched, i.e., no punched hole exists, at an intended punching position of the sheet P.

When the sheet P that has already been punched at the intended punching position passes, the following signals will be supplied to the controller 46: the signal level switches from "Low" to "High" when the leading edge of the sheet comes in, switches from "High" to "Low" when the leading edge reaches a punched hole, switches from "Low" to "High" when the leading edge passes the punched hole, and switches from "High" to "Low" when the trailing edge of the sheet passes.

When the above signal is received, it is determined that a punched hole is present.

The descriptions will now be given of how a user actually operates the sheet processor 1 constructed as described above, and of the punching operation control.

The descriptions will initially be given of the actual operation performed by the user to make, for example, the setting for punching in an inserting paper mode when a sheet of inserting paper has punched holes.

Figure 5:
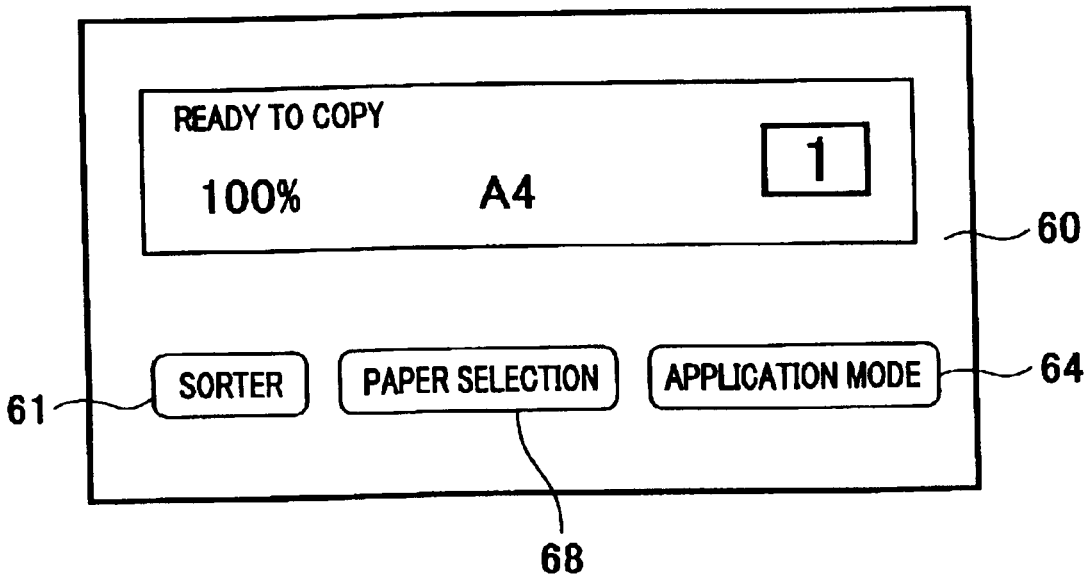
FIG. 5 is a diagram showing an initial screen of a display panel of the copying machine.
Figure 6:
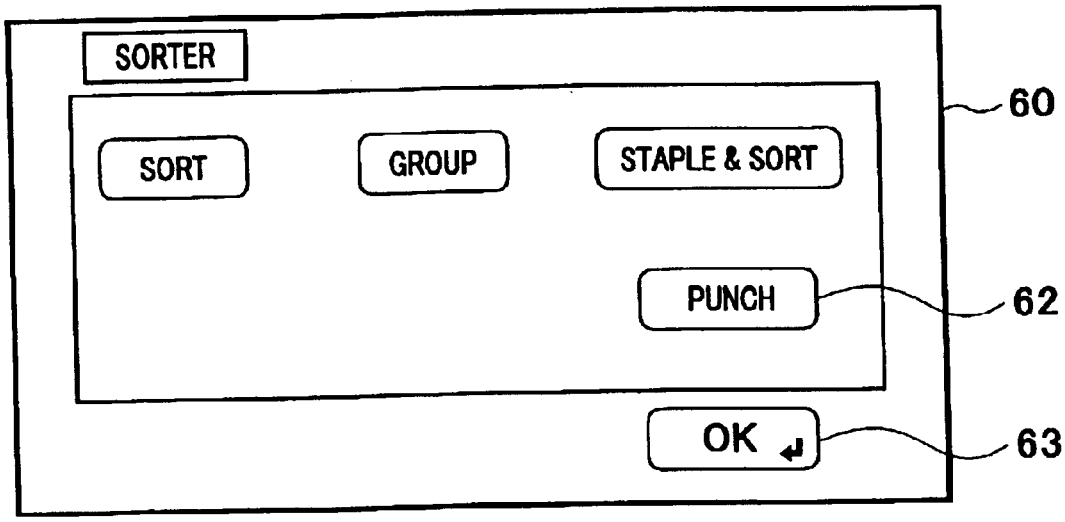
FIG. 6 is a diagram showing a screen when "SORTER" key on the display panel has been pressed.

First, a "SORTER" key 61 displayed on the initial screen of a display panel 60 shown in FIG. 5 that is provided on the main unit 2 is pressed, and then a "PUNCH" key 62 on the detail screen shown in FIG. 6 is pressed, the detail screen appearing when the SORTER key 61 is pressed. Subsequently, an "OK" key 63 is pressed to bring up the screen again shown in FIG. 5, and then an "APPLICATION MODE" key 64 on the screen is pressed.

Figure 7:
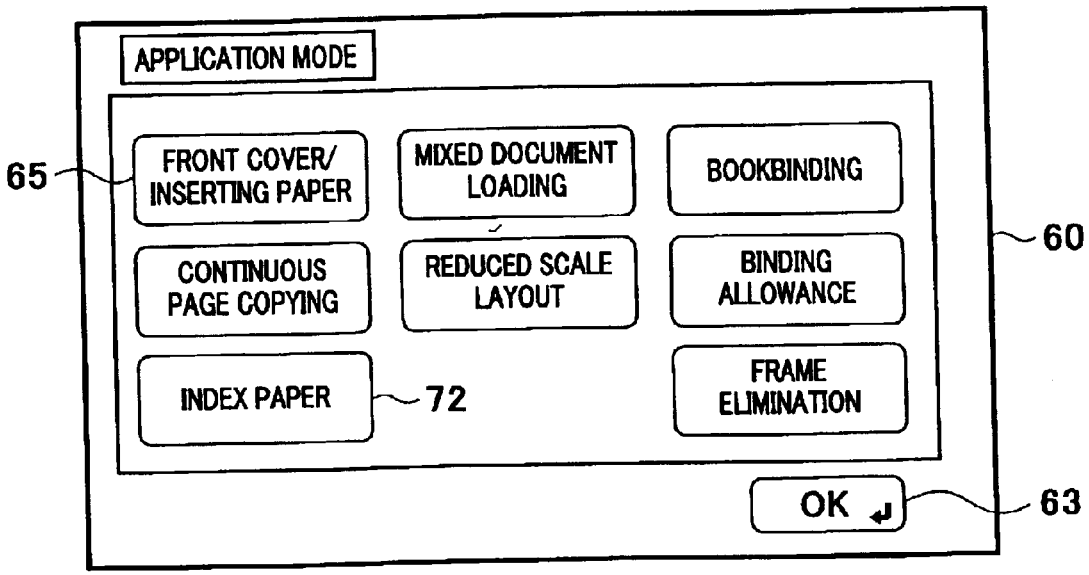
FIG. 7 is a diagram showing a screen when "APPLICATION MODE" key on the display panel has been pressed.
Figure 8:
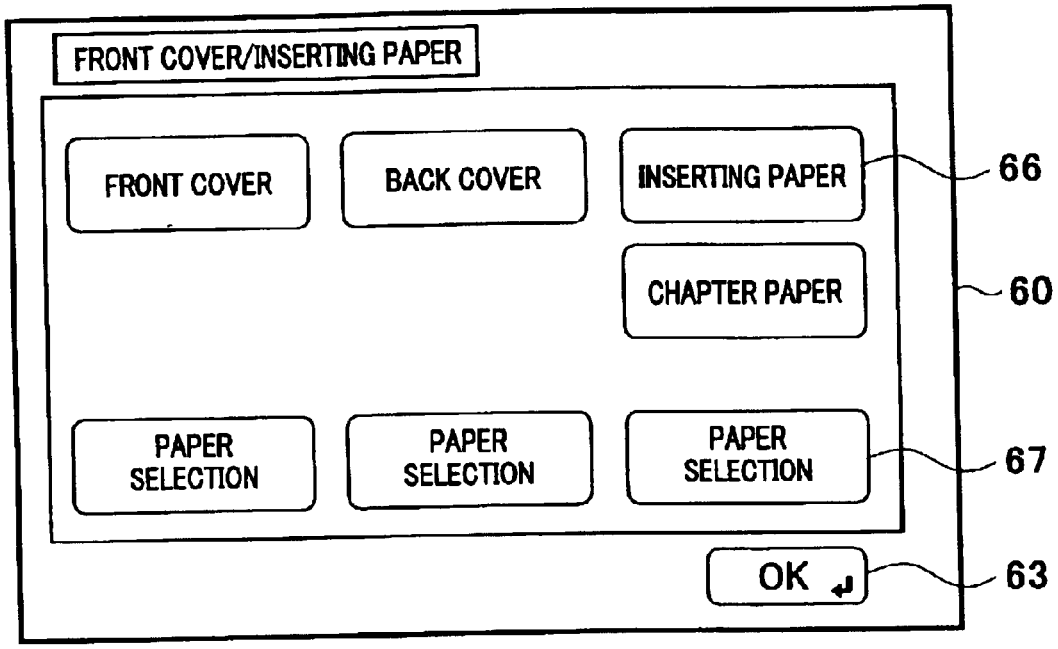
FIG. 8 is a diagram showing a screen when "FRONT COVER/INSERTING PAPER" key on the display panel has been pressed.

When the "APPLICATION MODE" key 64 is pressed, the detail screen shown in FIG. 7 appears. A "COVER/INSERTING PAPER" key 65 on the detail screen is pressed. This brings up the detail screen shown in FIG. 8. An "INSERTING PAPER" key 66 at top right on the detail screen is pressed, then the sheet cassette 8 accommodating the sheets of inserting paper or the manual paper feed tray 12 is selected by using a "PAPER SELECTION" key 67.

In this embodiment, the inserting paper is accommodated in, for example, the manual paper feed tray 12; therefore, the manual paper feed tray 12 is selected, then the "OK" key 63 is pressed to go back to the original screen shown in FIG. 5. Next, in order to select the paper feed stage of plain paper, the sheet cassette 8 is selected by pressing the "PAPER SELECTION" key 68. Lastly, a predetermined document is set on the document feeder 5, and a "START" key (not shown) is pressed to start the operation for forming an image.

When the operation for forming the image is begun as mentioned above, the image is formed on one or two sides of the sheet P, as described above. After that, the sheet P on which the image has been formed on one or both sides thereof is conveyed to the sheet processor 1.

Figure 9:
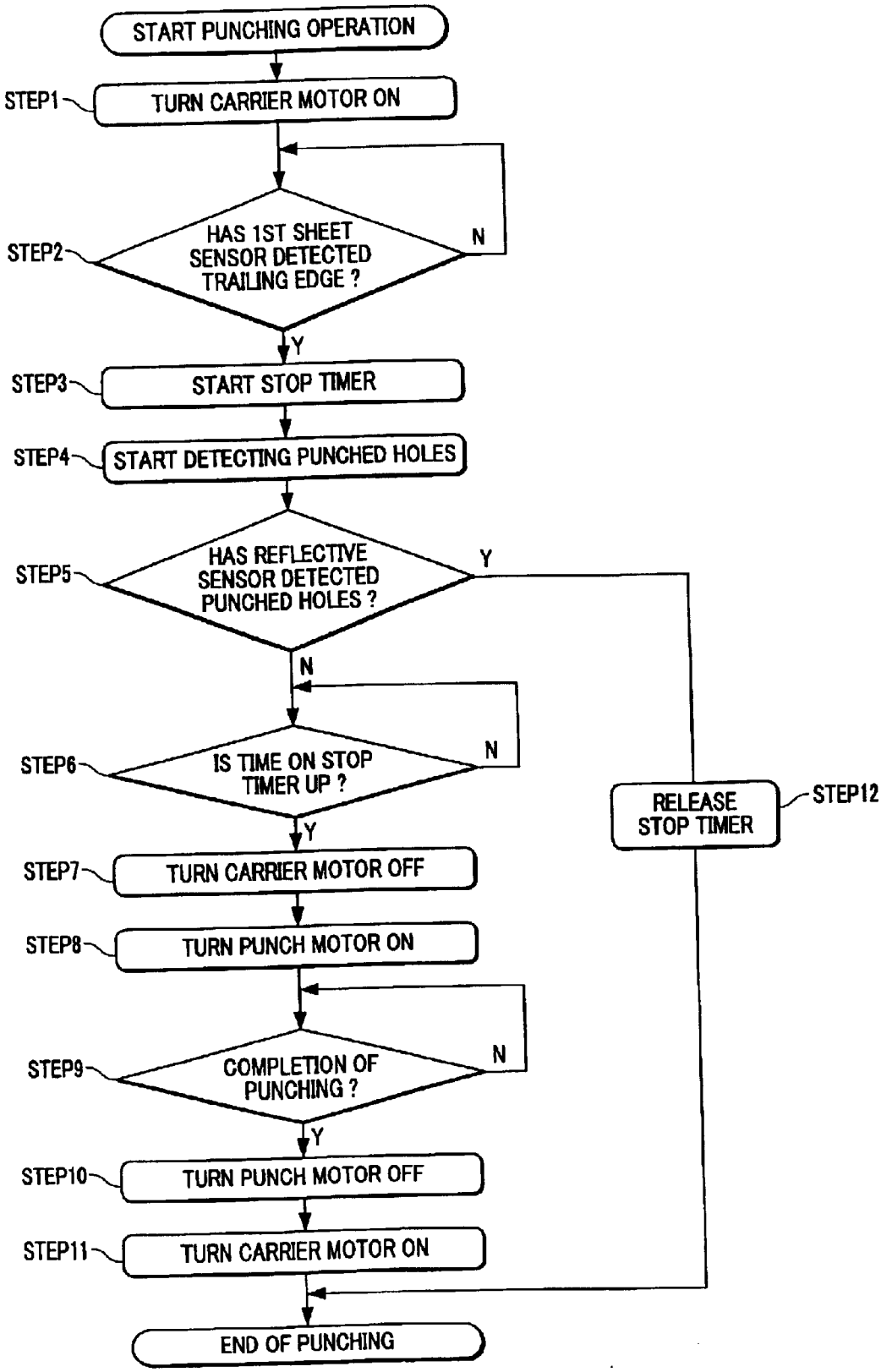
FIG. 9 is a flowchart illustrating the control of the punching operation in the embodiment.

Referring now to the flowchart shown in FIG. 9, the descriptions will be given of the punching operation control by the controller 46.

First, the sheet P is further conveyed toward the punching apparatus 50 by the pair of inlet rollers 20 and the pair of first conveying rollers 21. At this time, the conveyance motors (not shown) for driving the conveying rollers on the upstream and downstream sides of the punching apparatus 50 are ON (step 1).

With the conveyance motors ON, when the trailing edge of the conveyed sheet is detected by the first sheet sensor 22 (step 2), a stop timer is started to carry the sheet P until an intended punching position on the—sheet trailing edge coincides with the punching position of the punching apparatus 50 (step 3). At the same time, the monitoring of a signal output from the reflective sensor 55 is begun so as to detect an already punched hole, and the detection of the already punched hole is started (step 4).

If the level of a signal from the reflective sensor 55 does not switch from high to low before the intended punching position on the sheet trailing edge meets the punching position of the punching apparatus 50, that is, if no pre-punched hole is detected, (N in step 5), then the conveyance motor is turned OFF (step 7) as soon as the time set on the stop timer is up thereafter (Y in step 6), and the punch motor 52 is turned ON (step 8).

Upon completion of the punching operation for punching at the intended punching position of the sheet P (Y in step 9), the punch motor 52 is turned OFF (step 10). After the punching operation is completed, the conveyance motor is turned back ON (step 11) to convey the punched sheet from the punching apparatus 50, and the system prepares for receiving the next sheet.

If the level of a signal from the reflective sensor 55 switches from high to low before the intended punching position in the sheet trailing edge meets the punching position of the punching apparatus 50, i.e., if the pre-punched hole is detected by the reflective sensor 55 (Y in step 5), then the aforesaid stop timer is released (step 12), and the punching operation is terminated.

Thus, the reflective sensor 55 detects whether a punched hole has already been punched at the intended punching position, and if the punched hole already exists at the intended punching position, then the punching operation is not carried out. This arrangement makes it possible to prevent a final punched hole from becoming excessively large. Thus, sheets can be punched without causing degraded alignment for filing or poor quality of binding. Moreover, the automated operation permits the user-friendliness to be improved.

In the above embodiment, the reflective sensor 55 is disposed at one location. Alternatively, however, as many reflective sensors as the number of punching rods 53 may be disposed at the positions corresponding to the punching rods 53. In this case, the control is carried out so that the punching operation is not performed if any of the reflective sensors detects a punched hole.

The above descriptions have been given of the case where the punching operation is prohibited if a pre-punched hole is found; the present invention, however, is not limited thereto. Alternatively, if a pre-punched hole is found, then the punching position may be shifted.

Figure 10:
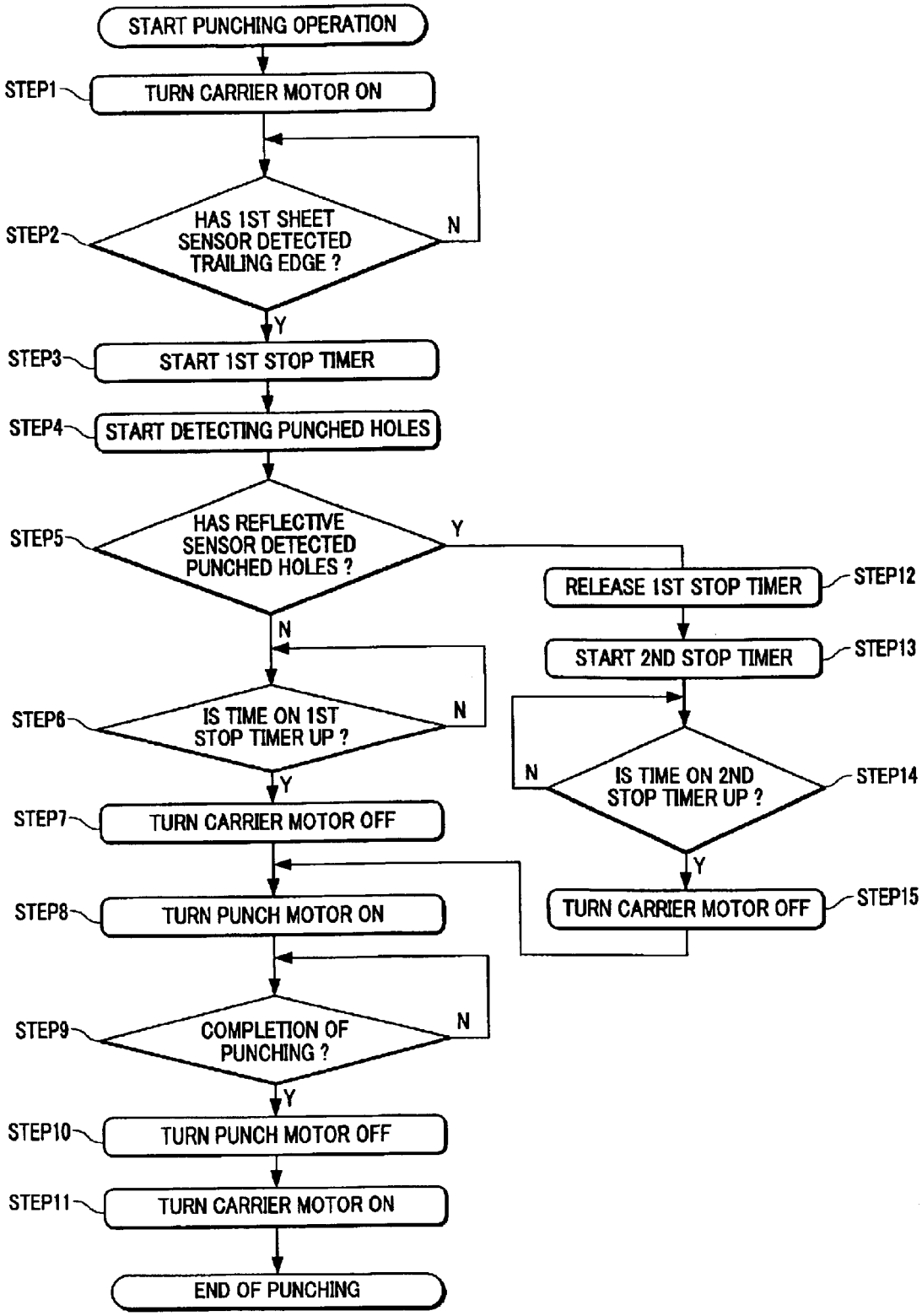
FIG. 10 is a flowchart illustrating the control of the punching operation in a sheet processor according to a second embodiment of the present invention.

Referring now to the flowchart shown in FIG. 10, the control of the punching operation in a sheet processor in accordance with a second embodiment of the present invention will be explained.

As already mentioned above, when the conveyance motor, which is the conveying device, is ON (step 1), the moment a first sheet sensor 22 detects the trailing edge of a conveyed sheet P (step 2), a controller 46 starts a first stop timer (step 3) to carry the sheet P until an intended punching position in the sheet trailing edge meets the punching position of a punching apparatus 50. At the same time, the monitoring of a signal output from a reflective sensor 55 is begun to detect a pre-punched hole so as to begin the detection of the pre-punched hole (step 4).

If the level of a signal from the reflective sensor 55 switches from high to low before an intended punching position in a sheet trailing edge meets a punching position of the punching apparatus 50, i.e., if a pre-punched hole is detected, then a first stop timer is released (step 12), and a second stop timer is started (step 13). When the time set on the second stop timer is up (Y in step 14), a conveyance motor is turned OFF (step 15).

In this case, the time set on the second stop timer is shorter than the time set on the first stop timer, so that the sheet P stops before the intended punching position in the sheet trailing edge area meets the punching position of the punching apparatus 50. At this position, a punch motor 52 is turned ON (step 8) to punch the leading edge of the sheet, allowing the sheet to be punched at the position shifted from the punched hole already punched.

If no punched hole is detected (N in step 5), then the conveyance motor is turned OFF (step 7) when the time set on the first stop timer is up (Y in step 6), and the punch motor 52 is turned ON (step 8) to begin punching. Upon completion of the punching (Y in step 9), the punch motor 52 is turned OFF (step 10), then the conveyance motor is turned ON (step 11) to carry the punched sheet from the punching apparatus 50, and the system prepares for receiving the next sheet.

Thus, the reflective sensor 55 detects whether a punched hole already exists at the intended punching position, and if a punched hole is found at the intended punching position, then the punching position is shifted to the leading edge of the sheet. In other words, the conveyance motor is controlled to carry the sheet P to a punching position other than the intended punching position. With this arrangement, the sheet can be punched at a position other than the position where a punched hole already exists.

As a result, it is possible to prevent the size of a final hole from becoming excessive, so that sheets can be punched without causing degraded user-friendliness or poor alignment when filing or deteriorated binding quality.

In this embodiment, if a punched hole is found at an intended punching position, the punching position is changed to the leading edge of the sheet. Alternatively, however, if space allows, the punching position may be changed to the trailing edge of the sheet by setting the time on the second stop timer to be longer than the time set on the first stop timer.

In the above descriptions, the construction has been discussed in which the reflective sensor 55 detects whether a punched hole has been made at an intended punching position, and if a punched hole is found at the intended punching position, then the punching operation is not performed or the punching position is changed. The present invention, however, is not limited thereto. Alternatively, in the case of a sheet that has a punched hole already punched at an intended punching position, presetting may be made so as not to carry out the punching operation.

A third embodiment in accordance with the present invention will now be described.

The descriptions initially will be given of the method of the actual operation performed by a user to set for punching in the inserting paper mode when the inserting paper has punched holes.

First, the "SORTER" key 61 displayed on the display screen of the display panel shown in FIG. 5 is pressed, then the "PUNCH" key 62 on the detail screen shown in FIG. 6 is pressed, the detail screen appearing when the SORTER key 61 is pressed. Subsequently, the "OK" key 63 is pressed to again bring up the screen shown in FIG. 5, then the "APPLICATION MODE" key 64 on the screen shown in FIG. 5 is pressed.

Figure 11:
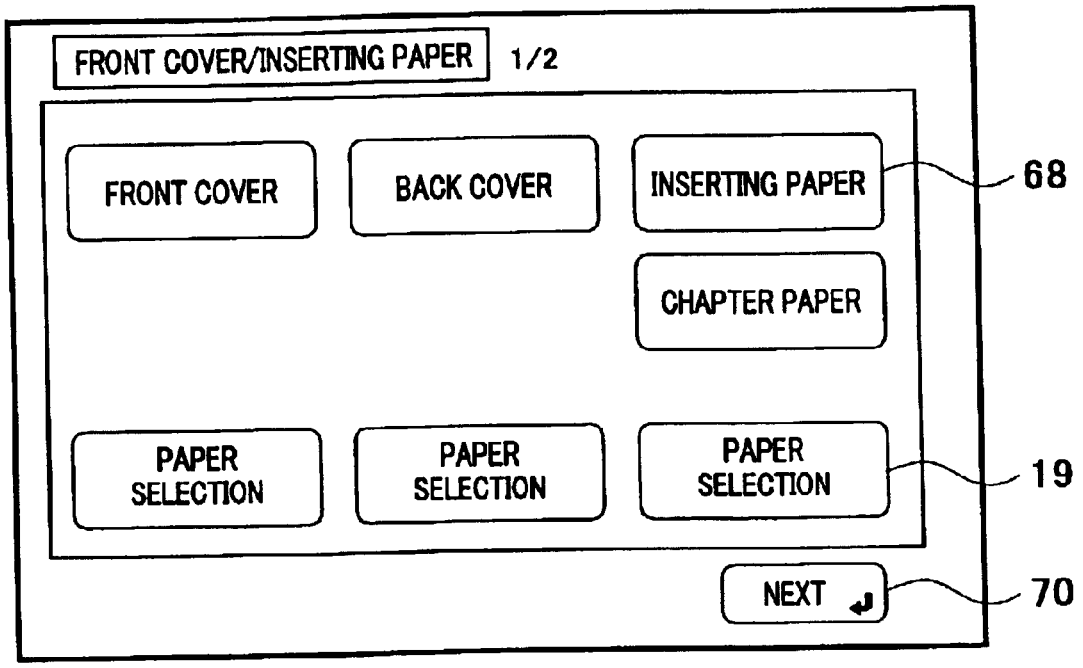
FIG. 11 is a diagram showing a screen "FRONT COVER/INSERTING PAPER" key on the display panel of the copying machine according to a third embodiment of the present invention has been pressed.

When the "APPLICATION MODE" key 64 is pressed, the detail screen shown in FIG. 7 appears. The "COVER/INSERTING PAPER" key 65 on the detail screen is pressed. This brings up the detail screen shown in FIG. 11. An "INSERTING PAPER" key 68 at the top right on the detail screen is pressed, then the sheet cassette 8 accommodating the sheets of inserting paper or the manual paper feed tray 12 is selected by pressing a "PAPER SELECTION" key 69. In this embodiment, the inserting paper is accommodated in, for example, the manual paper feed tray 12; therefore, the manual paper feed tray 12 is selected.

Figure 12:
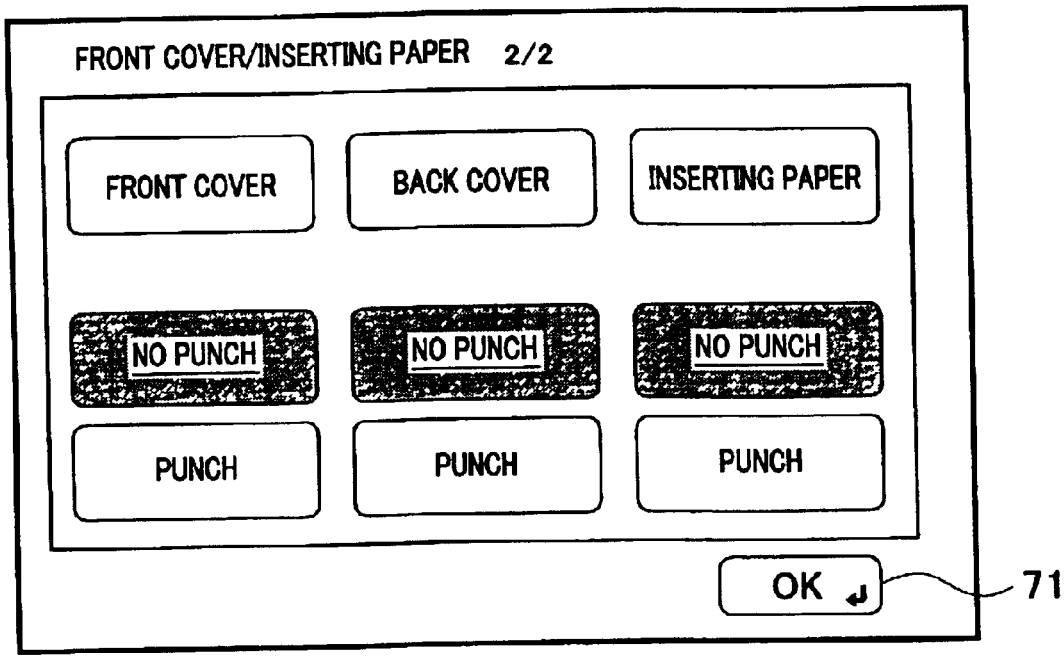
FIG. 12 is a diagram showing a screen when "NEXT" key on the display panel has been pressed.

After that, a "NEXT" key 70 is pressed to go to the next screen shown in FIG. 12, which shows the detailed setting for punching. As shown in FIG. 12, this screen allows the user to set whether the punching operation should be carried out for each sheet accommodated in the sheet cassette 8 and the manual paper feed tray 12. It is possible to arbitrarily set to perform the punching operation or not to perform the punching operation for a front cover, a back cover, and each sheet of the inserting paper by selecting either "PUNCH" or "NO PUNCH". In this embodiment, the inserting paper is already punched; hence, the "NO PUNCH" rather than the "PUNCH" is selected.

Alternatively, the initial setting for "PUNCH" or "NO PUNCH" shown in FIG. 12 may be preset according to whether the "PUNCH" key 62 on the "SORTER" screen shown in FIG. 6 discussed above is pressed. To be more specific, if the "PUNCH" key 62 is pressed, then the "PUNCH" mode will be automatically set on the detailed punch setting screen.

After the "NO PUNCH" is selected, an "OK" key 71 is pressed to go back to the original screen, and then the "PAPER SELECTION" key 68 shown in FIG. 5 is pressed to select the sheet cassette 8 so as to select the plain paper feed stage. Lastly, a predetermined document is set on the document feeder 5, and a start key (not shown) is pressed to begin the image forming operation.

Figure 13:
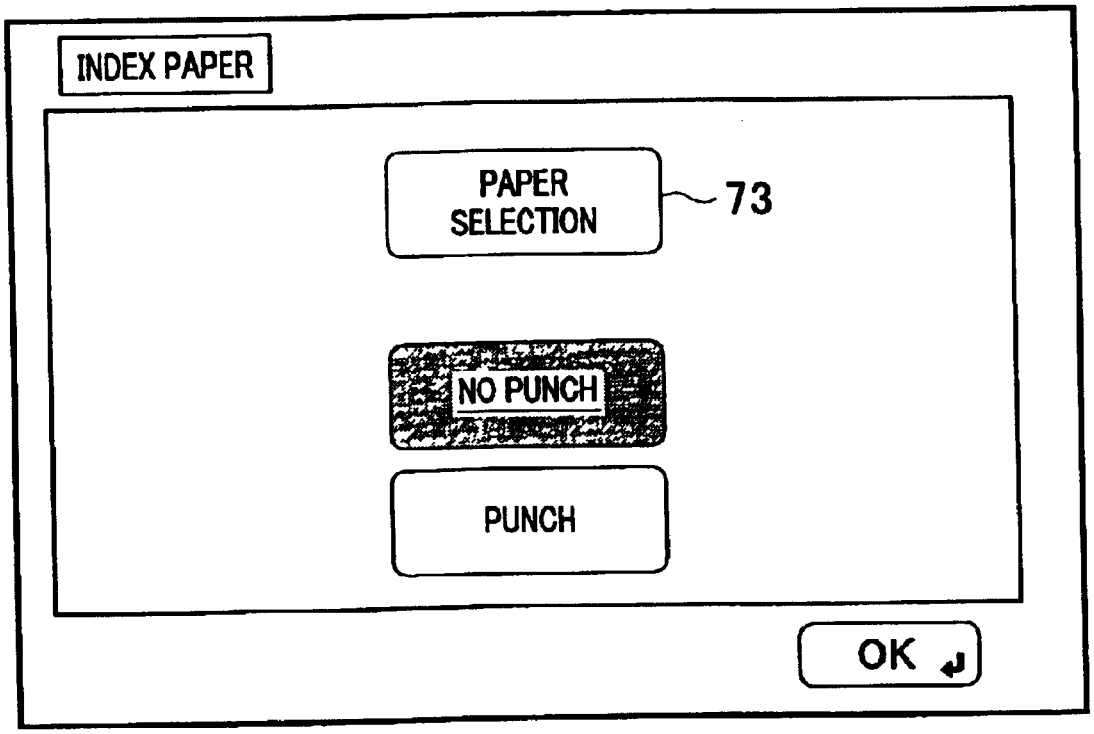
FIG. 13 is a diagram showing a screen when "INDEX PAPER" key on the display panel has been pressed.

If index paper has punched holes, then an "INDEX PAPER" key 72 in the "APPLICATION MODE" shown in FIG. 7 is pressed to select the insertion mode for tab paper or the like. After pressing the "INDEX PAPER" key 72, a "PAPER SELECTION" key 73 shown in FIG. 13 is pressed to select the sheet cassette in which the index paper has been set, and either "PUNCH" or "NO PUNCH" is arbitrarily selected.

Figure 14:
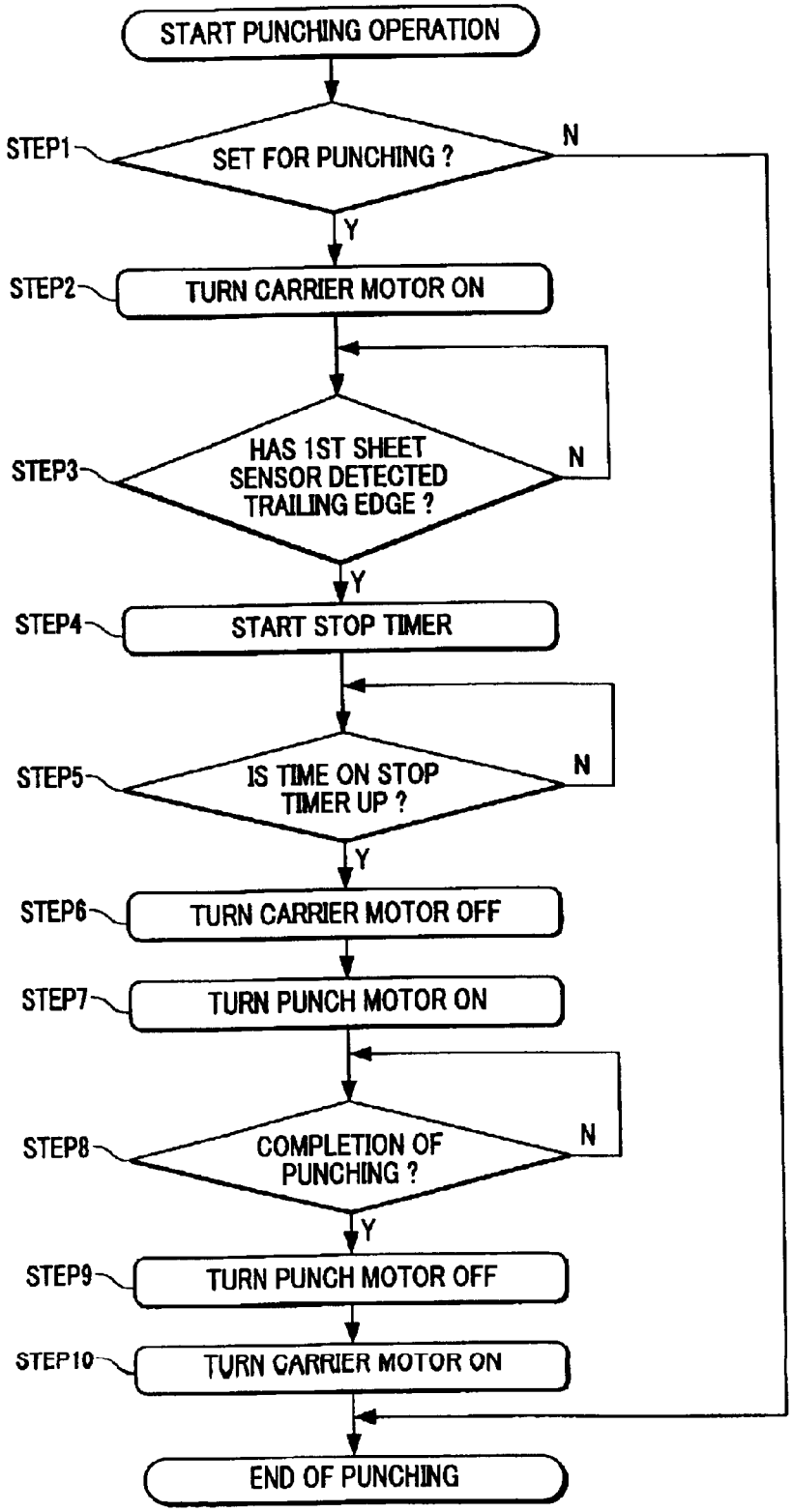
FIG. 14 is a flowchart illustrating the control of the punching operation in a sheet processor according to the embodiment.

Referring now to the flowchart shown in FIG. 14, the descriptions will be given of the control of the punching operation in the sheet processor according to this embodiment.

First, it is determined whether the punching has been set for a conveyed sheet (step 1), and if the determination result is negative (N in step 1), then the procedure is terminated without carrying out the punching operation. If the determination result is affirmative (Y in step 1), then the conveyance motor is turned ON (step 2).

When the conveyance motor is ON, the moment the trailing edge of the conveyed sheet is detected by the first sheet sensor 22 (Y in step 3), the stop timer is started (step 4) so as to convey the sheet P until the intended punching position in the sheet trailing edge meets the punching position of the punching apparatus 50. Thereafter, when the time set on the stop timer is up (Y in step 5), the conveyance motor is turned OFF (step 6) and the punch motor 52 is turned ON (step 7).

Thus, a punched hole is punched at the intended punching position of the sheet P. When the punching operation is completed (Y in step 8), the punch motor 52 is turned OFF (step 9). After the completion of the punching operation, the conveyance motor is turned ON again (step 10) to convey the punched sheet from the punching apparatus 50, and the system prepares to receive the next sheet.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet processor for punching, by a punching unit, a sheet of paper on which an image has been formed, comprising:

a punched hole detector for detecting whether a punched hole has already been punched at an intended punching position in the sheet of paper along the upstream side of the punching unit; and controlling means for controlling the punching unit so as not to carry out a punching operation if it is determined that the punched hole has already been punched at the intended punching position on the basis of a signal from the punched hole detector.

2. A sheet processor for punching, by a punching unit, a sheet of paper on which an image has been formed, comprising:

a punched hole detector for detecting whether a punched hole has already been punched at an intended punching position in the sheet of paper along the upstream side of the punching unit;

conveying means for conveying the sheet of paper to the punching unit; and controlling means for controlling the conveying means to convey the sheet of paper to a position other than a position where the punching unit will punch a hole at the intended punching position if it is determined that a punched hole has already been punched at the intended punching position wherein the determination is made on the basis of a signal from the punched hole detector.

3. The sheet processor according to claim 1 or 2, wherein the punching unit has a plurality of pairs of punching portions, and the punched hole detector is provided at at least one location in a location in a sheet conveyance area corresponding to the plurality of punching portions.

4. A sheet processor for punching, by a punching unit, a sheet of paper on which an image has been formed, comprising:

a plurality of sheet accommodating trays for accommodating sheets of paper before images are formed thereon;

punching setting means for setting whether to carry out a punching operation for each sheet of paper accommodated in the plurality of sheet accommodating trays; and controlling means for controlling the punching operation of the punching unit on the sheets of paper respectively accommodated in the plurality of sheet accommodating trays on the basis of the setting made by the punching setting means.

5. An image forming apparatus comprising:

an image forming unit; and a sheet processor for punching, by a punching unit, a sheet of paper on which an image has been formed, comprising:

a punched hole detector for detecting whether a punched hole has already been punched at an intended punching position in the sheet of paper along the upstream side of the punching unit; and controlling means for controlling the punching unit so as not to carry out a punching operation if it is determined that the punched hole has already been punched at the intended punching position on the basis of a signal from the punched hole detector.

6. An image forming apparatus comprising:

an image forming unit; and a sheet processor for punching, by a punching unit, a sheet of paper on which an image has been formed, comprising:

a punched hole detector for detecting whether a punched hole has already been punched at an intended punching position in the sheet of paper along the upstream side of the punching unit;

conveying means for conveying the sheet of paper to the punching unit; and controlling means for controlling the conveying means to convey the sheet of paper to a position other than a position where the punching unit will punch a hole at the intended punching position if it is determined that a punched hole has already been punched at the intended punching position, wherein the determination is made on the basis of a signal from the punched hole detector.

7. An image forming apparatus comprising:

an image forming unit; and a sheet processor for punching, by a punching unit, a sheet of paper on which an image has been formed, comprising:

a punched hole detector for detecting whether a punched hole has already been punched at an intended punching position in the sheet of paper along the upstream side of the punching unit; and controlling means for controlling the punching unit so as not to carry out a punching operation if it is determined that the punched hole has already been punched at the intended punching position on the basis of a signal from the punched hole detector, wherein the punching unit has a plurality of pairs of punching portions, and the punched hole detector is provided at at least one location in a sheet conveyance area corresponding to the plurality of punching portions.

8. An image forming apparatus comprising:

an image forming unit; and a sheet processor for punching, by a punching unit, a sheet of paper on which an image has been formed, comprising:

a punched hole detector for detecting whether a punched hole has already been punched at an intended punching position in the sheet of paper along the upstream side of the punching unit;

conveying means for conveying the sheet of paper to the punching unit; and controlling means for controlling the conveying means to convey the sheet of paper to a position other than a position where the punching unit will punch a hole at the intended punching position if it is determined that a punched hole has already been punched at the intended punching position, wherein the determination is made on the basis of a signal from the punched hole detector, wherein the punching unit has a plurality of pairs of punching portions, and the punched hole detector is provided at at least one location in a sheet conveyance area corresponding to the plurality of punching portions.

9. An image forming apparatus comprising:

an image forming unit; and a sheet processor for punching, by a punching unit, a sheet of paper on which an image has been formed, comprising:

a plurality of sheet accommodating trays for accommodating sheets of paper before images are formed thereon;

punching setting means for setting whether to carry out a punching operation for each sheet of paper accommodated in the plurality of sheet accommodating trays; and controlling means for controlling the punching operation of the punching unit on the sheets of paper respectively accommodated in the plurality of sheet accommodating trays on the basis of the setting made by the punching setting means.

10. A sheet processor comprising:

a punching rod for punching a sheet of paper;

a motor for driving the punching rod;

a reflective sensor for detecting whether there is a preexisting hole at an intended punching position in a sheet of paper; and controlling means for controlling the motor so as to carry out punching if the reflective sensor does not detect a preexisting hole and not to carry out punching if the reflective sensor detects a preexisting hole.

11. The sheet processor according to claim 10, wherein a plurality of the punching rods and one such reflective sensor are included.

12. The sheet processor according to claim 10, wherein a plurality of the punching rods and an equal number of such reflective sensors as the number of the punching rods are included.

* * * * *

UNITED STATES PATENT AND TRADEMARK OFFICE

CERTIFICATE OF CORRECTION

PATENT NO. : 6,860,478 B2
DATED : March 1, 2005
INVENTOR(S) : Katsuaki Hirai

It is certified that error appears in the above-identified patent and that said Letters Patent is hereby corrected as shown below:

Title page,
Item [56], References Cited, FOREIGN PATENT DOCUMENTS,
"08059048 A" should read -- 8-59048 --.
"11029254 A" should read -- 11-29254 A --.
"11310337 A" should read -- 11-310337 A --.
"2001335230 A" should read -- 2001-335230 A --.
"2002264086 A" should read -- 2002-26408bA --.

Column 3,
Line 51, "its" should read -- their --.

Column 6,
Line 67, "the_sheet" should read -- the sheet --.

Signed and Sealed this

Twelfth Day of July, 2005

JON W. DUDAS
*Director of the United States Patent and Trademark Office*